US005670089A

United States Patent [19]

Oba et al.

[11] Patent Number: 5,670,089

[45] Date of Patent: Sep. 23, 1997

[54] CONDUCTIVE PASTE FOR MLC TERMINATION

[75] Inventors: Takayuki Oba; Akira Inaba, both of Kanagawa, Japan

[73] Assignee: E. I. Du Pont de Nemours and Company, Wilmington, Del.

[21] Appl. No.: 568,920

[22] Filed: Dec. 7, 1995

[51] Int. Cl.[6] ..... H01B 1/02; H01B 1/16; H01B 1/22

[52] U.S. Cl. ..... 252/514; 252/512; 106/1.18; 106/1.19

[58] Field of Search ..... 252/512, 514; 106/1.18, 1.19

[56] References Cited

U.S. PATENT DOCUMENTS

| | | | |
|---|---|---|---|
| 4,004,057 | 1/1977 | Hoffman et al. | 428/209 |
| 5,089,172 | 2/1992 | Allison et al. | 252/512 |
| 5,346,651 | 9/1994 | Oprosky et al. | 252/514 |
| 5,363,271 | 11/1994 | Pepin | 361/320 |

OTHER PUBLICATIONS

Patent Abstracts of Japan, vol. 16, No. 185 (E–1197), 6 May 1992 & JP–A–04 023308 (Mitsubishi Materials Corp), 27 Jan. 1992.

Patent Abstracts of Japan, vol. 16, No. 196 (E–1200), 12 May 1992 & JP–A–04 028110 (Kyocera Corp), 30 Jan. 1992.

Patent Abstracts of Japan, vol. 18, No. 527, (E–1613), 5 Oct. 1994 & JP–A–06 188145 (Kyocera Corp), 8 Jul. 1994.

JEE Journal of Electronic Engineering, vol. 28, No. 299, Nov. 1991, Tokyo, JP, pp. 58–62, XP00273336, Hiroshi Amano: "Reliable Laminated Ceramic Capacitor Carries Innovative External Electrodes" pp. 58–59.

*Primary Examiner*—Paul Lieberman
*Assistant Examiner*—Mark Kopec

[57] ABSTRACT

The purpose of this invention is to provide a terminal electrode composition for a multiple-layered capacitor that is suitable for a plating base and that has improved resistance to heat stress as the result of sintering at a low temperature (high reliability). The terminal electrode composition for multiple-layered capacitor of this invention is made of precious metal particles and 0.5–7 wt. % (based on the weight-of the precious metal particles) of an inorganic binder having a 400°–500° C. glass transition point and a 400°–550° C. glass softening point.

4 Claims, No Drawings

CONDUCTIVE PASTE FOR MLC TERMINATION

FIELD OF THE INVENTION

This invention concerns a terminal electrode composition for a multiple-layered capacitor; more specifically, this invention concerns a terminal electrode composition for a multiple-layered capacitor made of precious metal particles and an inorganic binder, and sintered at low temperature.

BACKGROUND OF THE INVENTION

Conventional conductive pastes made by dispersing precious metals (such as silver/palladium) and an inorganic binder dispersed in an organic binder have been used as terminal electrode materials for multiple-layered ceramic capacitors. The convention conductive paste was required to be conductive following the sintering process, to adhere to the element assembly of the capacitor before and after the sintering process, and to be made adhesive by soldering after the sintering process. A composition, having improved adhesiveness with respect to the element assembly of the capacitor before and after the sintering process, and made by combining a composition of precious metal and an inorganic binder with nickel oxide (NiO, 0.1–10 wt. % based on the weight of the precious metal) was described in U.S. Pat. No. 3,922,387.

There were various problems associated with the improvements in highly dense surface mounting techniques. In order to metalize the conventional conductive paste, sintering at 800°–900° C. (a comparatively high temperature, especially at 750°–950° C. as described in the above-mentioned U.S. Patent) was required. In the case of sintering in the above-mentioned temperature range to form a terminal electrode for the capacitor, the metal components in the paste could diffuse into the inner electrode of the capacitor, or could become sintered and could shrink in the junction of the terminal electrode and the element assembly of the capacitor, or the inorganic binder in the paste could diffuse into the element assembly of the capacitor, resulting in the generation of large inner stresses in the capacitor. As a result, rapid temperature changes generate cracking in the element capacitor assembly when soldering, or performing modification soldering onto the circuit substrate of a chip capacitor. Or in the case of a substrate that became bent due to external stresses, the capacitor could become cracked.

As conventional conductive pastes were subject to comparatively high temperatures in the case of using the pastes for terminal electrodes, their resistance to soldering heat stress was poor, and the circuit substrate of the chip capacitor had poor resistance to bending (poor resistance to deformation). When sintering, cracks were easily produced due to inner stresses in the element assembly of the capacitor, so that conventional conductive pastes were not reliable.

In the case of sintering a conventional conductive paste at 650°–780° C. (a comparatively low temperature), the resistance to deformation could be improved; however, poor density resulted so the other chip capacitor properties might also be impaired. The conventional conductive paste was not reliable.

The purpose of this invention is to provide a composition which can be used to form a terminal electrode, has suitable properties for use as a chip capacitor and which also has high mechanical strength and high reliability (high resistance to heat stress) for which the sintering takes place at 650°–780° C. (a comparatively low temperature).

The inventors found that in the case of using an inorganic binder having specific values for the glass transition point and glass softening point of the conductive paste, a terminal electrode having high reliability could be made by sintering at a comparatively low temperature; the invention was then completed.

SUMMARY OF THE INVENTION

The terminal electrode composition of this invention has a high sintering density with the capacitor due to sintering at low temperature, and has high resistance to heat stress (reliability), high mechanical strength, and good plating adhesiveness. A highly reliable capacitor can be made using the product of this invention; since the production requires a low temperature, production is economical.

Therefore this invention is directed to a terminal electrode composition for a multiple-layered capacitor, characterized by being made of precious metal particles and 0.5 to 7 wt. % (based on the weight of the precious metal particles) of an inorganic binder having a 400°–500° C. glass transition point and a 400°–550° C. glass softening point.

DETAILED DESCRIPTION OF THE INVENTION

This invention involves a terminal electrode composition for a multiple-layered capacitor, and is characterized by being made of precious metal particles and 0.5–7 wt. % (based on the weight of the precious metal particle) of inorganic binder having a 400°–500° C. glass transition point and a 400°–550° C. glass softening point.

Examples of precious metal particles include the following: white gold, palladium, gold, silver, ruthenium, osmium, their mixtures (two or more) and alloys. Silver is preferred. Either a spherical silver particle having a 0.05–10 μm particle size or an amorphous silver particle or a flaky silver particle (0.1–10 μm) or their mixture is especially preferred.

Neither the case of an excessively large or small particle size for the precious metal particle is preferred because the mixing properties of the precious metal particles with the inorganic binder are impaired.

The inorganic binder has a 400°–500° C. glass transition point and a 400°–550° C. glass softening point.

The glass softening point of the inorganic binder has considerable influence on the sintering temperature. In the case of a value which is too high, the inorganic binder inhibits sintering. In the case of a value which is too low, the binder accelerates sintering. In order that the composition not be excessively sintered and be suitably dense, the glass softening point is desirably 400°–550° C.

Glass frits containing at least one of the following, e.g., 5–30 wt. % $SiO_2$; 1–18 wt. % $B_2O_3$; 35–70 wt. % Pbo; at least one of the following, 1–20 wt. % ZnO and CuO; at least one of the following, 5–20 wt. % $Al_2O_3$, $ZrO_2$ and $TiO_2$; at least one of the following, 0.5–10 wt. % $Na_2O$ and $Li_2O$, may suitably be used as the inorganic binder having the above-mentioned properties. At least one of the following, i.e., 0.01–3 wt. % $Al_2O_3$, $ZrO_2$, and $TiO_2$ may be added to the above- mentioned composition.

$SiO_2$ influences the glass softening point of the inorganic binder. In the case of a binder containing an excessive amount [of $SiO_2$], the softening point is increased. $B_2O_3$ decreases the viscosity of the composition, increases the wetting properties with the substrate, and accelerates sintering of the precious metal particles. PbO, $Na_2O$ and $Li_2O$ decrease the viscosity of the composition and increase the wetting properties with the substrate. Both ZnO and CuO increase the adhesiveness with the substrate. $Al_2O_3$, $ZrO_2$ and $TiO_2$ improve the resistance to acids, resulting in improved resistance to the plating solution. A terminal electrode with balanced properties can be made by sintering in the case of using the components in the amounts of the above-mentioned ranges.

The amount of inorganic binder added is suitably 0.5–7 wt. %, preferably 1–5 wt. %, based on the weight of precious metal particles. If an insufficient amount of the inorganic binder is added, a sintered product with unsatisfactory density and plating-solution barrier properties results when sintering at 650°–780° C. (a low temperature), and poor adhesion to the element assembly of the capacitor occurs.

A fine powder having a 0.01–10 μm, preferably 0.1–3 μm, particle size is used as the inorganic binder. If a powder with a particle size which exceeds or falls short of the above-mentioned range, the mixing properties with the precious metal particles are exacerbated.

The terminal electrode can be made by dispersing the above-mentioned precious metal particles and inorganic binder in either water or an organic medium to form a paste, followed by application of the paste as a coating at the site where the terminal electrode of the multiple-layered capacitor is to be formed, then sintering at 650°–780° C. After sintering, either a nickel plating is added or soldering is done to make the final terminal electrode.

An organic medium which can be completely burned at the above-mentioned sintering temperature (so that no residue resulting from incomplete sintering is present in the sintered membrane). Examples of organic media include solutions, which are usually used for pastes, and which are made by dissolving the following resins, are: rosin, cellulose derivate, acrylic resin, alkyd resin, in the following organic solvents, e.g., terpineol; butyl carbinol; Carbitol acetate.

The amount of water or of the organic medium added is 10–70 wt. %, preferably 20–40 wt. %, based on the weight of precious metal particles.

An organic binder having the above-mentioned properties is used, so that the binder can fill the pores of either the sintered surface or the sintered membrane at a 650°–780° C. sintering temperature, and so that a suitable density for the terminal electrode results, so that good contact of the terminal electrode with the element assembly of the capacitor results, so that the melted solder does not interfere with the terminal electrode and the element assembly of the capacitor, and so that satisfactory adhesion strength of the terminal electrode to the element assembly of the capacitor and satisfactory mechanical strength (resistance to distortion) result.

The terminal electrode composition for the multiple capacitor of this invention is used as the base for either nickel plating or for soldering to maintain heat resistance. This composition is especially effective in preventing the plating solution from first getting into the terminal electrode and then into the electrode, which might otherwise occur when plating.

EXAMPLES

Preparation of Inorganic Binder

The components required for conventional glass production or their precursors (such as $H_3BO_3$ for $B_2O_3$) were mixed together in the required ratios, then heated and melted. The component mixture was heated to the peak temperature at which the mixture melted and liquefied, then gas generation was stopped. The peak temperature was 1100°–1500° C., especially at 1200°–1400° C. Then, the melted component mixture was placed in cold water for abrupt cooling, then crushed using a roll mill. Samples for Application Examples 1–5, and Comparative Examples 6–12 were made.

The compositions (wt. %), glass transition points, and glass softening points of each of the samples are shown in Table 1.

TABLE I

| | Sample Number | | | | | | | | | | | |
|---|---|---|---|---|---|---|---|---|---|---|---|---|
| Component | 1 | 2 | 3 | 4 | 5 | 6 | 7 | 8 | 9 | 10 | 11 | 12 |
| $SiO_2$ | 23.0 | 29.2 | 21.8 | 28.0 | 22.3 | 6.0 | 5.4 | 15.5 | 34.0 | 33.0 | 34.0 | 37.5 |
| $B_2O_3$ | 8.5 | 5.5 | 11.6 | 8.0 | 19.2 | 12.0 | 12.4 | 9.6 | 3.0 | — | 9.5 | 4.8 |
| PbO | 66.0 | 57.0 | 46.0 | 56.0 | 37.5 | 80.6 | 78.1 | 73.4 | 48.0 | 63.0 | 44.0 | 43.6 |
| ZnO + CuO | — | 1.7 | 11.5 | — | 12.6 | 1.4 | — | — | 0.6 | — | — | — |
| $TiO_2$ +$Al_2O_3$ + $ZrO_2$ | 2.5 | 5.1 | 9.1 | 8.0 | 8.4 | — | 4.1 | 0.6 | 10.4 | 4.0 | 12.5 | 4.3 |
| $Na_2O$ or $Li_2O$ | — | 3.5 | — | — | — | — | — | 0.9 | 4.0 | — | — | — |
| Others | — | — | — | — | — | — | — | — | — | — | — | 9.8 |
| glass transition point (°C.) | 415 | 425 | 470 | 470 | 490 | 335 | 370 | 380 | 450 | 520 | 515 | 570 |
| glass softening point (°C.) | 470 | 475 | 525 | 525 | 535 | 365 | 400 | 415 | 555 | 570 | 600 | 625 |

Preparation of Paste

Flaky silver particles having a 3 μm average particle size were mixed with spherical silver particles having a 1 μm average particle size in a ratio of 60:40 (by weight), then 3 wt. % (based on the weight of the silver) of inorganic binder (made in the above-mentioned 1) was added, and 25.84 wt. % (based on total weight) of the organic medium was added, then all of the components were mixed using a roll mill to make the paste.

Evaluation Test

The paste made in the previous section was applied as a coating to an alumina substrate, then sintered at 650° C., at 690° C., at 730° C., and at 780° C. to make samples for evaluation. The sintering density, the resistance to heat stress (reliability), the mechanical strength (deformation), and the plating adhesiveness were all evaluated.

The sintering density was evaluated by examining the cross section of the sintered membrane with a scanning electron microscope.

The resistance to heat stress was evaluated by the solder heat resistance test based on JIS C 5102.

The mechanical strength was evaluated by the bending test based on JIS C 5102.

The plating adhesiveness was evaluated by standard nickel plating/soldering.

The evaluation results are shown in Table II using a 5 point method (5: good, . . . 1: poor).

TABLE II

| inorganic binder number | 1 | 2 | 3 | 4 | 5 | 6 | 7 | 8 | 9 | 10 | 11 | 12 |
|---|---|---|---|---|---|---|---|---|---|---|---|---|
| sintering density | 4 | 4 | 4 | 4 | 4 | 5 | 5 | 5 | 2 | 2 | 1 | 1 |
| resistance heat stress | 4 | 5 | 5 | 5 | 5 | 1 | 2 | 3 | 1 | 1 | 1 | 1 |
| mechanical strength (deformation) | 5 | 5 | 4 | 4 | 4 | 5 | 5 | 5 | 3 | 3 | 2 | 1 |
| plating adhesiveness | 4 | 4 | 4 | 4 | 4 | 4 | 2 | 2 | 1 | 1 | 1 | 2 |

What is claimed is:

1. A terminal electrode composition for a multiple-layered capacitor, characterized by being made of precious metal particles and 0.5 to 7 wt. % (based on the weight of the precious metal particles) of an inorganic binder having a 400°–500° C. glass transition point and a 400°–550° C. glass softening point, wherein said inorganic binder comprises 15–30 wt. % $SiO_2$, 1–18 wt. % $B_2O_3$, 35–70 wt. % PbO and 5–20 wt. % of at least one oxide selected from the group consisting of $Al_2O_3$, $ZrO_2$ and $TiO_2$.

2. The composition described in claim 1, wherein said inorganic binder further comprises 1–20 wt. % of at least one oxide selected from the group consisting of ZnO and CuO, and 0.5–10 wt. % of at least one oxide selected from the group consisting of $Na_2O$ and $Li_2O$.

3. The composition described in claim 1, wherein said inorganic binder further comprises an additional 0.01–3 wt. % of at least one oxide selected from the group consisting of $Al_2O_3$, $ZrO_2$ and $TiO_2$.

4. The composition described in claim 1, wherein said precious metal particles are silver, and wherein said silver particles have a particle size of 0.05 to 10 microns.

* * * * *